US009693128B2

(12) United States Patent
Seo

(10) Patent No.: US 9,693,128 B2
(45) Date of Patent: Jun. 27, 2017

(54) ARMBAND-TYPE EARPHONE

(71) Applicant: Dongsik Seo, Gangwon-do (KR)

(72) Inventor: Dongsik Seo, Gangwon-do (KR)

( * ) Notice: Subject to any disclaimer, the term of this patent is extended or adjusted under 35 U.S.C. 154(b) by 0 days.

(21) Appl. No.: 14/893,593

(22) PCT Filed: May 25, 2014

(86) PCT No.: PCT/KR2014/004651

§ 371 (c)(1),
(2) Date: Nov. 24, 2015

(87) PCT Pub. No.: WO2014/193125

PCT Pub. Date: Dec. 4, 2014

(65) Prior Publication Data

US 2016/0119707 A1 Apr. 28, 2016

(30) Foreign Application Priority Data

May 25, 2013 (KR) ..... 10-2013-0059384

(51) Int. Cl.
*H04R 1/10* (2006.01)
*H04R 1/06* (2006.01)

(52) U.S. Cl.
CPC ..... *H04R 1/1033* (2013.01); *H04R 1/06* (2013.01); *H04R 1/1016* (2013.01); *H04R 1/105* (2013.01)

(58) Field of Classification Search
CPC ..... H04R 1/1033; H04R 1/1016
See application file for complete search history.

(56) References Cited

U.S. PATENT DOCUMENTS 6,374,126 B1 * 4/2002 MacDonald, Jr. ..... H04M 1/05 381/309
7,436,974 B2 * 10/2008 Harper ..... H04R 1/1033 381/374
7,610,661 B2 * 11/2009 Sween ..... B65H 75/06 24/129 R
7,693,295 B2 * 4/2010 Harper ..... H04R 1/1033 381/374
8,189,843 B2 * 5/2012 Harper ..... H04R 1/1033 381/374

(Continued)

FOREIGN PATENT DOCUMENTS

KR 20-0225471 Y1 6/2001
KR 20-0396764 Y1 9/2005

(Continued)

OTHER PUBLICATIONS

International Search Report for PCT/KR2014/004651 mailed Aug. 29, 2014.

*Primary Examiner* — Matthew Eason
(74) *Attorney, Agent, or Firm* — STIP Law Group, LLC

(57) ABSTRACT

The present invention is characterized in that coupling units are placed on upper and lower ends of the body of a conventional earphone, one coupling unit of respective coupling units is coupled, the earphone cord is wound between the coupling units, and the other coupling unit is coupled, thereby binding the earphone cord. The present invention makes it possible to prevent the cord from being twisted while being contained after earphone binding and to use the cord ring, which is created in the binding process, to hold the earphone on the user's body or a portable device.

2 Claims, 5 Drawing Sheets

(56) References Cited

U.S. PATENT DOCUMENTS 8,249,286 B2 * 8/2012 Nault ..... H04R 1/1033 381/182
8,913,774 B2 * 12/2014 Zheng ..... H04R 1/1016 381/374
9,288,566 B2 * 3/2016 Minarik ..... H04R 1/1033
2007/0086617 A1 * 4/2007 Loh ..... H04R 1/1033 381/374
2008/0317274 A1 * 12/2008 Kim ..... H04R 1/1058 381/370
2009/0013504 A1 * 1/2009 Crespo ..... H01R 13/72 24/306
2011/0252607 A1 * 10/2011 Rothbaum ..... B65H 75/285 24/303
2011/0252609 A1 * 10/2011 Rothbaum ..... H01F 7/0263 24/306
2011/0290532 A1 * 12/2011 Cano, Jr. ..... H04R 1/1033 174/135
2011/0308049 A1 * 12/2011 Sun ..... B65D 63/1027 24/306
2013/0298356 A1 * 11/2013 Scandora ..... F16B 1/00 24/303
2014/0140568 A1 * 5/2014 Im ..... H04R 1/1033 381/384
2015/0163580 A1 * 6/2015 Wallaja ..... H04R 1/1033 381/384
2015/0189420 A1 * 7/2015 Demier ..... H04R 1/1033 24/122.3
2015/0225150 A1 * 8/2015 Farrell ..... B65D 63/14 24/16 PB
2015/0312668 A1 * 10/2015 White ..... H04R 1/1033 381/374
2015/0365755 A1 * 12/2015 Harper ..... H04R 1/1033 381/384
2016/0050481 A1 * 2/2016 Moats ..... H04R 1/1033 381/384
2016/0353192 A1 * 12/2016 Huang ..... H04R 1/1033

FOREIGN PATENT DOCUMENTS

KR 10-2012-0034076 B1 4/2012
KR 10-1142400 B1 5/2012

* cited by examiner

ARMBAND-TYPE EARPHONE

CROSS-REFERENCE TO RELATED APPLICATIONS

This application is the U.S. National Phase under 35 U.S.C. §371 of International Application No. PCT/KR2014/004651 filed on May 25, 2014, which in turn claims the benefit of Korean Application No. 10-2013-0059384, filed on May 25, 2013, the disclosures of which are incorporated by reference into the present application.

TECHNICAL FIELD

The present invention relates to a device capable of fixing cables of a typical earphone and a method thereof, and more particularly, to an earphone capable of simply accommodating the earphone cables by using a method in which two pairs of coupling units that couple the respective branched ends of an acoustic locator (hereinafter, referred to as an earphone body) of the earphone are provided and the cables are wound while passing between the coupling units without an additional tool for arranging the cables.

BACKGROUND ART

The typical earphone that has been sold on the market are stereo earphones (or earplugs) having a 3-pole 3.5Φ terminal, and has a structure in which a cable connected to earphone heads at both ends from an input terminal is branched at an intermediate portion.

When the earphone is not used, the earphone is normally stored by being wound, and in this case, there is a problem (hereinafter, referred to as Problem-1) that the earphone is stored while the end of the earphone passes through the inside of a coil. When a part of the end is pulled, there is a problem that the coil is shortened and is tangled.

When the cable of the earphone is wound, there is a problem (hereinafter, referred to as Problem-2) that the coil is twisted, and when a part of the end is also pulled in the case of Problem-2, there is a problem that the earphone is tangled.

DISCLOSURE

Technical Problem

The existing technologies of the patent and the utility model in which an auxiliary tool for winding the earphone or an auxiliary device of winding the earphone cable such as a device of winding a cord of a cleaner is attached have a disadvantage that portability is degraded in the method for solving Problem-1 and Problem-2. Particularly, in a patent [KR 2009-0024565 (Mar. 9, 2009)] related to an operation of removing a branching point of the earphone, when the earphone cable is wound, Problem-1 is not still solved. In a patent and a utility model similar to a patent [1994-0023766 (Oct. 22, 1994), attachment tool for preventing earphone of mobile phone from being tangled] related to an operation of connecting the earphone heads to a cord, Problem-2 is not solved, or the earphone is not wound in a small size.

Technical Solution

In order to achieve the above object, the present invention provides an earphone capable of autonomously solving such problems without an additional device while maintaining a shape by using a method in which and a pair of lower-end fixing units of the earphone are coupled by additionally providing upper-end fixing units and lower-end fixing units are provided at a typical earphone and including an elastic member and cables are bound by winding the cables between the lower-end fixing units like a hair clip for woman and coupling the upper-end fixing units.

In order to provide elasticity for fixing the bound cables, the present invention provides a force between an elastic force for allowing the internally bound cables not to be separated and an elastic force for allowing the durability of the cables not to be reduced under half of the average using time by using a material having elasticity as the earphone body or the elastic member.

Effect of the Invention

In order to solve the problems of the related art, an object of the present invention is to provide an earphone that is not greatly different from the original shape while autonomously serving as a binding device such that the original portability of the earphone is not degraded while cables are not untangled.

DESCRIPTION OF DRAWINGS

The left side of FIG. 1 is a plan view of earphones, and the right side thereof is a front view of the earphones.

The upper left side of FIG. 2 is a left side view of the earphones, the lower left side thereof is a right side view, and the right side thereof is a rear view.

BEST MODE

The present invention contains the contents of the detailed description of the registration patent invention (Korean Patent Application No. 10-2013-0059384) which claims the priority.

Figure 1:
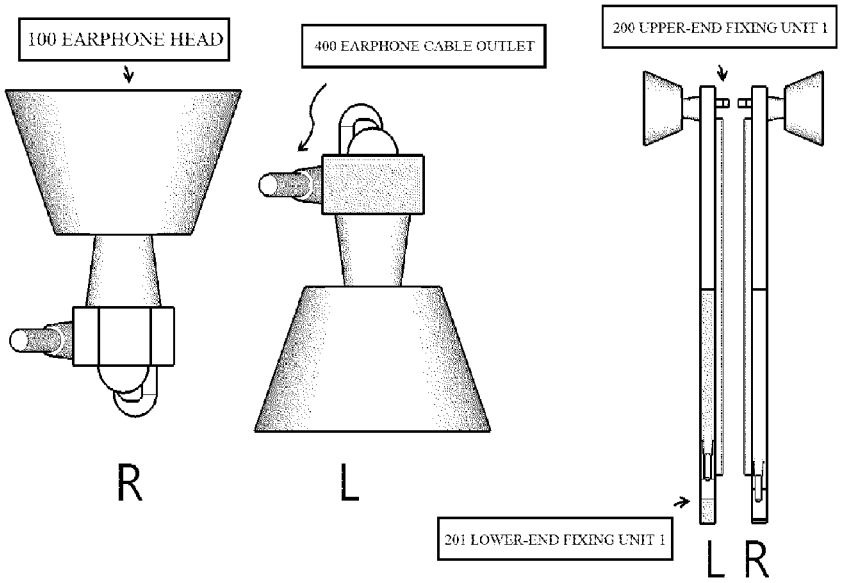

As shown in FIG. 1, cables connected to a pair of earphones connected by temporarily coupling a lower-end fixing unit 1 to a lower-end fixing unit 2 of an earphone are wound by being rotated using winder bodies, and the wound cables are fixed by coupling the upper-end fixing unit 1 and the upper-end fixing unit 2. The releasing of the cables are performed in a reverse order.

DESCRIPTION OF THE PREFERRED EMBODIMENTS

Hereinafter, the configuration and operation of the present invention will be described in detail with reference to the accompanying drawings. When the present invention is described with the accompanying drawings, the same components will be assigned the same reference numeral regardless of the reference signs of the drawings, and the redundant description thereof will be omitted. Although the terms 'first,' 'second', etc. may be used herein to describe various components, the components should not be limited by these terms. These terms are only used to distinguish one element from another.

Figure 2:
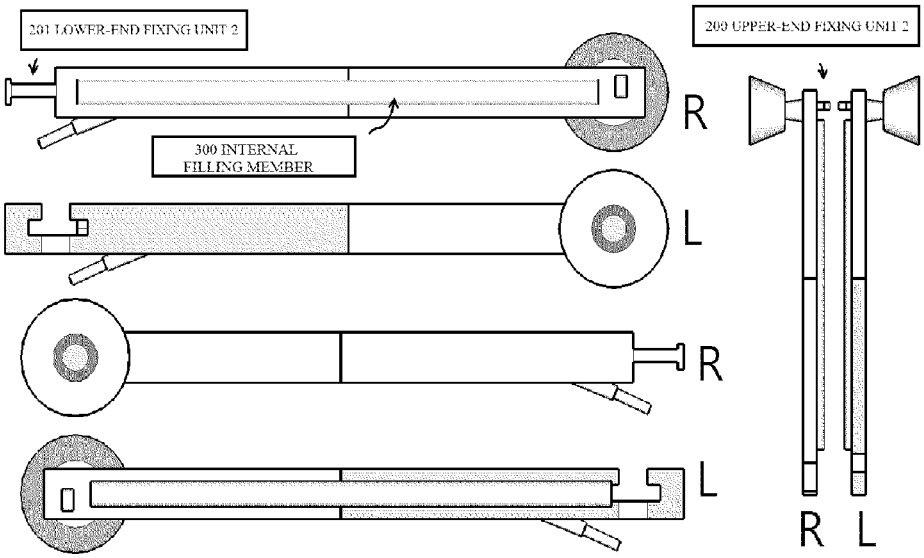
Figure 3:
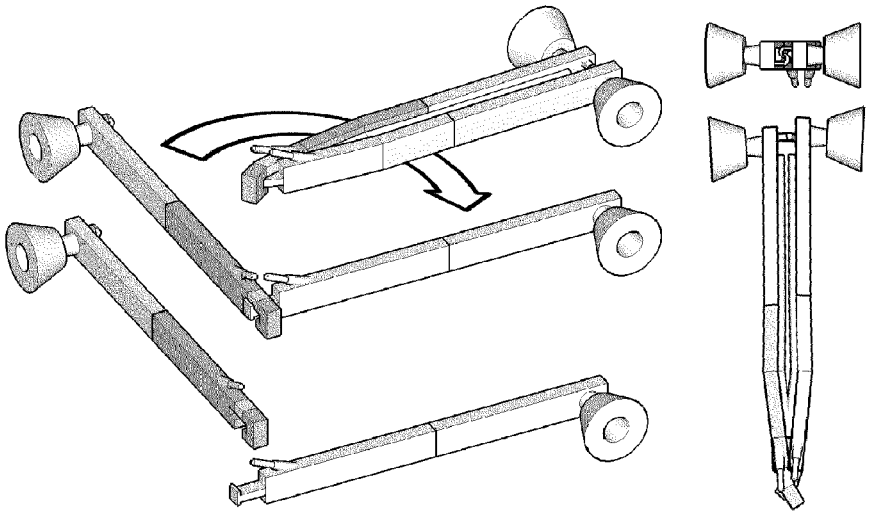
FIG. 3 is a perspective view showing a case where a left earphone and a right earphone are coupled and is a diagram showing the usage state thereof.
Figure 4:
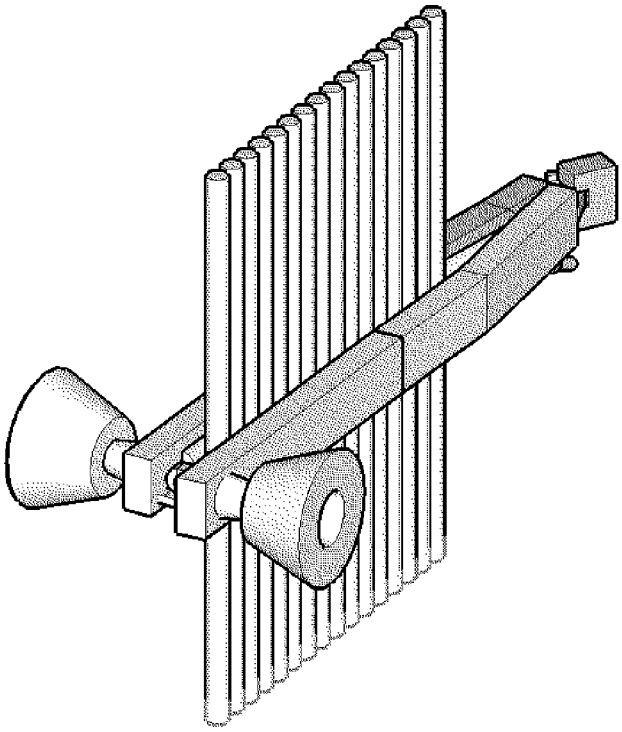
FIG. 4 is a perspective view showing a case where earphone cables are bound by coupling the lower ends of the left earphone to the right earphone, winding earphone cables between the left and right earphones and coupling upper-end fixing units.

FIG. 1 is a conceptual diagram showing the structure of earphones according to the present invention, FIG. 2 is a major conceptual diagram showing a major part of the present invention, and FIG. 3 is a diagram showing an operation state of the present invention.

The present invention provides an earphone set capable of winding cables by forming a winder area between earphones. More particularly, the earphone set includes a pair of earphone head units 100 into which speakers are respectively built; and a pair of winder bodies 500 in which the earphone head units are provided at the respective ends and coupling units 200 and 201 for coupling and uncoupling the earphones are provided on a surface. The pair of winder bodies are arranged so as to face each other, and the winder area around which earphone cables are wound is formed when the earphones are coupled.

The winder area refers to a closed curved surface formed when the upper-end fixing unit 200 and the lower-end fixing unit 201 are coupled. Accordingly, the winder area is not limited to the rear surface of the earphones, but is an area which is naturally formed when the upper-end fixing unit and the lower-end fixing unit are respectively arranged on outer surfaces of the earphones.

This means that there are various forms for coupling the branched earphone bodies depending on the arrangement form of the upper-end fixing unit and the lower-end fixing unit.

The upper-end fixing unit 200 and the lower-end fixing unit 201 are coupling units described in claim 2. The upper-end fixing unit may include an upper-end fixing unit 1 of FIG. 1 as a first fixing unit; and an upper-end fixing unit 2 of FIG. 2 as a second fixing unit, and may be constructed as the coupling unit. The lower-end fixing unit is constructed similarly to the upper-end fixing unit. Referring to the operation state of FIG. 3, an example of a coupling operation is as follows.

After the branched earphone bodies are arranged so as to face each other, when the lower-end fixing unit is inserted and is partially rotated, since the grooves of the lower-end fixing unit 1 and the lower-end fixing unit 2 of the lower-end fixing unit engage with each other, it is possible to temporarily maintain a fixed state. The earphone bodies can be easily rotated around their rotational shaft in such a state, but the earphone bodies are slightly moved depending on torque applied in a direction parallel to the rotational shaft.

When the temporarily fixed state is maintained, the earphone cables can be wound around a part of the winder area to be formed later, and the upper-end fixing unit 1 and the upper-end fixing unit 2 can be joined by further rotating the earphone bodies in order to couple the upper-end fixing unit.

The fixing units are further pressed is by applying force until the fixing units pass portions to which two rings are connected in a direction in which the upper-end fixing unit 1 and the upper-end fixing unit 2 are joined such that a groove of the upper-end fixing unit 2 engages with a sickle-shaped groove of the upper end fixing unit 1. Thereafter, when the ends of the passed rings enter the curved portions of the facing rings by applying torque in a direction in which the two rings are joined in the direction parallel to the rotational shaft of the lower-end fixing units, the force is released, and thus, the rings are coupled. When the rings are coupled, the closed curved surface is instantaneously formed, and the winder area is closed. The releasing is performed in a reverse order.

According to the present invention, the earphone head units include the speakers therein, and have the same structure as that of the typical earphone heads. However, the earphone head units may include a first fixing unit or a second fixing unit at a part of the outer surface. The earphone heat units constitute the end of a winder bodies.

Since an elastic member 300 shown in FIG. 1 is attached the inside of the winder area formed in the winder bodies, a relatively uniform pressure is applied to a non-uniform congestion state of the earphone cables passing through the winder area, and thus, it is possible to prevent a bundle of cables from being moved. Here, since the elastic member is allowed to have a shape in which prominences and depressions repeat, and it is possible to exhibit a function of allowing for the uniform cable arrangement. Since the elastic member is allowed to have an inclined height, it is possible to apply different pressures within the winder area.

Figure 5:
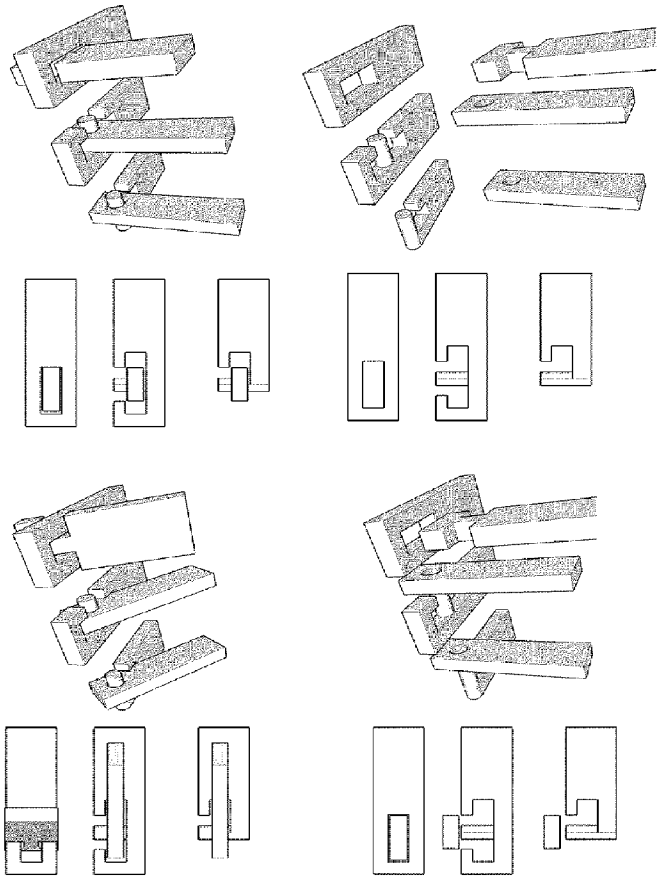
FIG. 5 is a perspective view showing an example of the coupling depending on the form of the lower-end coupling units.

As a modification example for implementing the effect according to the present invention, there are a method in which the upper-end fixing units or the lower-end fixing units are coupled or uncoupled by forming a groove or a shaft shown in FIG. 5, a method in which the first fixing unit or the second fixing unit is made of a magnetic material, a method in which a magnetic present at the earphone heat unit is used as the first fixing unit or the second fixing unit in the method using the fixing unit as the magnetic material, a method in which a restoration force is applied by inserting a spring that applies a rotational force of a clockwise direction or a counterclockwise direction on a planar surface perpendicular to the shaft formed after the upper-end fixing units or the lower-end fixing units are coupled, a method in which the winder area is formed by additionally attaching the winder bodies to a part of one earphone body, and a method in which the contacting is merely allowed by removing the upper-end fixing units or the lower-end fixing units.

In order to limit the degree of freedom by more accurately performing the fixation to a recessed portion where a connector and cables are joined and solve Problem-1 to be described below, since a portion where the cable starts is made of silicon or the same material as that of the connector, a threshold member capable of preventing sliding may be attached.

A principle of implementing the effect of the present invention will be described in detail as follows.

Since the mechanical phase is the same as the correlation (DNA topology) between 'stress due to a twisted state' of a ring-shaped plasmid DNA within prokaryotes among DNAs having a double helix structure and supercoiling (or superhelix) of the plasmid DNA. Thus, a principle of the earphones according to the present invention will be described using the theory.

In Expression 1 below,

Tw is Twisted, and represents the number of both strands constituting the inside of the closed coil overlap.

Lk is Linking number, and is the value of Tw formed by an average internal force. That is, when there is no external force, Lk=Tw.

Wr is writhe, and is the twisted number of secondary coils (superhelix) generated by the closed coil, that is, the number of the respective strands cross when viewed in a direction.

$$Lk=Tw+Wr \quad \text{[Expression 1]}$$

From Expression 1, it can be derived that when the coil is closed by forcibly adding a twisting force from the outside to the coil having a basic internal twisted number (i.e., 10 bp/turn in DNA), the closed coil forms the secondary coil in order to release the internal twisting force (Wr is decreased by an increased TW, and the twisting force is reduced).

The earphone cables that are actually used is normally Lk=0. The cables are not twisted, and are straightly stretched. Accordingly, when the cables are wound without being deviated, $$Lk=Tw=0$$

However, when the cables are normally wound, since a portion to be wound is rotated while maintaining a hand holding the cables so as not to rotate the section of the earphone cable, that is, while fixing the wrist, the winding number=Tw.

That is, when the earphone cords are wound, one twist appears at every one rotation. When the earphone cords are wound while untying the twist, the twist does not appear in the wound shape shown on the right side in the drawing. However, if the cables are wound as shown on the right side, in order to untie the twist generated at every rotation, the cables are put and the twist of the cables is untied whenever the cables are wound once. In such a winding method, since the repetitive operation steps need to be performed by the total rotation number, this winding method is not usually used due to a complicated operation.

When the cables are wound by a typical winding method in which the cables are wound by rotating around the hand holding the connected cables as its shaft while holding the earphone heads, the twist is generated, and Wr is reduced in order to remove the non-uniformity by the generated twist. This is originally because Lk=0. That is, Wr is decreased by 1 at every one rotation, and a property of reducing the stress due to the twist by forming the shape of the secondary coil is achieved. The adjacent cables are twisted due to such a property.

Accordingly, after the earphones are wound while holding the earphones, when the earphones are put in a pocket without an internal shaft or a fixation device, the cables are twisted by the repeated movement and the reduced Wr, and the cables are ultimately twisted. This is a reason why Problem-2 described in the [Background Art] is caused.

Accordingly, in order to solve Problem-2 described above, an object of the present invention is to perform the separation such that Tw (the respective units 1) present between the rings is not added. The earphone set of the present invention has a structure in which the cables passing through the earphones are fixed and the phases of the rings are fixed like "Mobius strip".

The rings are respectively formed as separate closed curves by providing the closed structure in which the inside is connected to the outside in a process of fixing the cables, and the stress Tw of the twisting force present in the rings is not mutually transmitted. Ultimately, even though Problem-2 of a tangled state in which other closed curves are included in the closed curves of the rings is caused before the closed structure is released, when the closed structure is released, since the earphone cords are sequentially untied, the earphone set has a structure that is not affected by such a tangled state.

Since the respective closed curves separated according to the present invention are separated by the fixation device, it seems as if the respective closed curves are tangled, but since the respective closed curves are substantially separated and are not mutually affected, the respective closed curves are not mutually affected until the fixation device is separated.

In conclusion, in the present invention, even though the rings are twisted due to the applying of a force constituting the superhelix or the applying of an external force like Problem-2, there is an advantage that the tangled structure is not mutually affected before the fixation device is separated. It is useful that a single closed curve having the closed structure connecting the inside of the coil to the outside maintains a coil shape.

Problem-1 is caused since the degree of freedom (refers to a degree at which an object is freely moved or bent under a certain condition) of the ends of the earphones positioned around the coil is high. The degree of freedom is determined depending on the material and the length between the fixation point and the end.

*When it is difficult to use hard earphone cables to such an extent that the degree of freedom can be greatly reduced in consideration of the usage form of the typical earphones, it can be seen that Problem-1 is caused since the length between the portion fixed to the coil and the end is long.

In order to simultaneously solve both Problem-2 and Problem-1, in the present invention, since the degree of freedom of the ends is reduced by using a method of fixing the portion around the end of the 3.5Φ connector to the fixation device, it is possible to prevent the ends of the earphones from churning within the coil. According to the present invention using the earphone bodies as a fixation tool, it is possible to simultaneously solve the problem of the existing technology which is a cause of Problem-1 by using the earphone bodies in addition to the end of the connector.

When an example of an actual fixing operation according to the present invention is described, (1) from a normal state in which the respective fixing units are released in order to normally use the earphones, (2) after the pair of lower-end fixing units 201 (1 and 2) of the earphones are coupled to each other, and (3) before the upper-end fixing units are coupled, the entire earphones are fixed in a necklace shape by intercros sing the ends of the cords and the body and coupling the upper-end fixing units 200 (1 and 2).

(1) to (3) in the example of the operation are stated in the description of FIG. 14 of the detailed description of the registration patent invention (Korean Patent Application No. 10-2103-0059384) which claims the priority, as described in the Best Mode.

When an example of a method in which the earphones are accommodated by actually winding the earphones around the wrist by using this fixing operation method is described, (1) after the lower-end fixing units 201 (1 and 2) are coupled, and the earphone heads are held by being fixed using a finger, (2) The other cable is wound around the body, and (3) the upper-end fixing units 200 (1 and 2) are coupled, and are bound.

The bound earphones are wound around the wrist like an accessory such as a bracelet, and in order to release and use the binding of the earphones, the operation is performed in a reverse order.

In order to store the earphones in the pocket by binding the earphones in a coil shape without winding the earphone around the wrist, the earphones are placed not on the wrist but on a palm, the earphones are formed in the coil shape in such an order, and when the hand is taken out, the shape of the earphones bound as the coil shape is completed. The releasing method is performed in a reverse order.

The above-described examples and additional descriptions are presented to describe the use examples and the accompanying drawings in order to minutely disclose the technical spirit included in the present invention, but are not intended to limit the scope of the present invention.

The invention claimed is:

1. An earphone comprising: a pair of winder bodies, wherein earphone head units are formed at the respective ends of the pair of winder bodies, and wherein, when the pair of winder bodies are arranged so as to face each other in a longitudinal direction of the winder bodies, the pair of winder bodies form a winder area where earphone cables are wound while passing between the pair of winder bodies arranged so as to face each other, wherein the winder bodies include at least one coupling unit that is formed on outer surfaces of the winder bodies arranged so as to face each other so as to couple the pair of winder bodies, wherein the earphone includes an elastic member that is disposed so as to protrude from the outer surface of the winder body at which the winder area is formed, and wherein the elastic member has a shape in which prominences and depressions repeat, and an inclined height.

2. The earphone according to claim 1, wherein the coupling unit includes:

a fixing unit (1) that is attached to one of the pair of winder bodies; and a fixing unit (2) that is attached to the other one.

* * * * *